United States Patent [19]

Miller

[11] Patent Number: 4,908,483

[45] Date of Patent: Mar. 13, 1990

[54] SENSING EDGE HAVING A PRESSURE SENSITIVE SWITCH FOR A DOOR

[75] Inventor: Norman K. Miller, Concordville, Pa.

[73] Assignee: Miller Edge, Inc., Concordville, Pa.

[21] Appl. No.: 396,493

[22] Filed: Aug. 21, 1989

[51] Int. Cl.[4] ..... H01H 3/16; E05F 15/00

[52] U.S. Cl. ..... 200/61.43

[58] Field of Search ..... 200/61.43, 86 R, 86 A; 49/26, 27, 28

[56] References Cited

U.S. PATENT DOCUMENTS 4,785,143 11/1988 Miller ..... 200/61.43

*Primary Examiner*—J. R. Scott

*Attorney, Agent, or Firm*—Panitch Schwarze Jacobs & Nadel

[57] ABSTRACT

A sensing edge for a door comprised of a pressure sensitive switch. The sensing edge protects persons, equipment and the door from impact damage. The sensing edge includes an outer sheath which is compressible upon application of external pressure. An elongate inner tubular member fabricated of resiliently compressible air impervious material is longitudinally positioned and enclosed within the sheath. A pressure sensitive switch is operatively associated with the inner tubular member. Upon application of external pressure to the sheath, pressure within the tube is increased and thereby communicated to the pressure switch for actuation of the switch to effect a desired result. A substantially rigid transverse structure within a portion of the outer sheath proximate the pressure switch prevents damage to the pressure switch.

12 Claims, 1 Drawing Sheet

SENSING EDGE HAVING A PRESSURE SENSITIVE SWITCH FOR A DOOR

FIELD OF THE INVENTION

The present invention relates to a sensing edge for a door and, more particularly, to a sensing edge having a pressure switch to protect persons, equipment and the door from impact damage.

BACKGROUND OF THE INVENTION

Employing pressure switches in sensing edges for doors is generally known. Such sensing edges generally include a sheath having several openings or chambers therein in fluid communication with each other, in order to transmit therebetween pressure changes in response to the application of external pressure to the sheath. The problem associated with such edges is that in order to construct several openings or chambers in fluid communication with each other, a plurality of different types and structures of foam must be used within the sheath to provide the proper sensitivity and path to communicate the pressure changes therebetween. Therefore, constructing and assembling door edges of this type is costly.

Other types of more conventional door edges include a pair of upper or lower, flexible, electrically conductive sheets (e.g., aluminum foil) positioned on the upper and lower sides of a bridge. Upon application of pressure to the sheath, the conductive sheets are deflected into electrically conductive engagement with each other to thereby function as a switch to actuate suitable control circuitry for controlling the door. Sensing edges with this type of construction may not be as sensitive as that contemplated by the present invention. For instance, before the control circuitry is actuated, the conductor sheets must travel the full distance therebetween in order to make electrical connection. Whereas, in the present invention, the control circuit may be actuated without forcing the control tube to deflect a significant amount, as will be apparent from the description hereinafter.

SUMMARY OF THE INVENTION

Briefly stated, the present invention comprises a sensing edge for a door to protect persons, equipment and the door from impact damage. The sensing edge comprises an elongate outer sheath compressible upon application of external pressure and fabricated of flexible air impervious material for attachment to a door edge. An elongate inner tubular member fabricated of resiliently compressible air impervious material is longitudinally positioned and enclosed within the sheath. The inner tubular member has a first end and a second end, the second end being sealingly closed. A substantially rigid, incompressible transverse structure is positioned within a portion of the outer sheath and has a configuration which complements the interior cross section of the sheath to effectively prevent deformation of the sheath thereabout. A pressure sensitive switch having a switch element is protectively located within the portion of the sheath proximate to the transverse structure for sensing pressure change within the inner tubular member without subjecting the switch element to direct external pressure, whereby upon application of external pressure to the sheath, anywhere therealong except at the portion encompassing the transverse structure, pressure within the tubular member is increased and thereby communicated to the pressure switch for actuation thereof.

BRIEF DESCRIPTION OF THE DRAWINGS

The foregoing summary, as well as the following detailed description of the preferred embodiment, will be better understood when read in conjunction with the appended drawings. For the purpose of illustrating the invention, there is shown in the drawings an embodiment which is presently preferred, it being understood, however, that the invention is not limited to the specific methods and instrumentalities disclosed. In the drawings.

DETAILED DESCRIPTION OF THE PREFERRED EMBODIMENT

Figure 1:
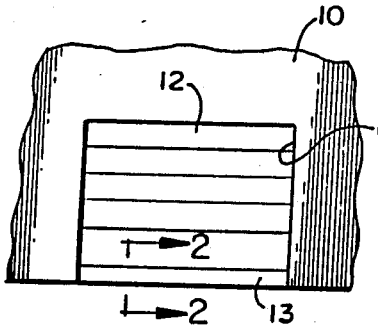
FIG. 1 is an elevational view showing a door construction including a sensing edge in accordance with the present invention.

Certain terminology is used in the following description for convenience only and is not limiting. The words "right," "left," "lower," and "upper" designate directions in the drawings to which reference is made. The words "inwardly" and "outwardly" refer to directions toward and away from, respectively, the geometric center of the sensing edge and designated parts thereof. The terminology includes the words above specifically mentioned, derivatives thereof and words of similar import.

Referring to the drawings, wherein like numerals indicate like elements throughout, there is shown in FIG. 1 a building wall 10 having a doorway 11 provided with a door 12. While the door 12, as illustrated, is an overhead door, having a sensing edge 13 in accordance with the present invention along its lower side or leading edge, it is within the spirit and scope of the invention to incorporate the sensing edge described hereinafter along the edge of any door structure, such as vertically disposed or horizontally movable doors, as desired.

Figure 2:
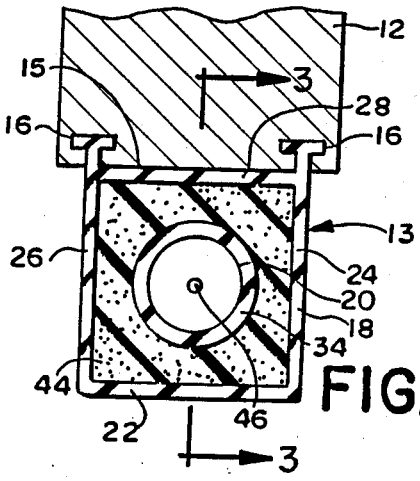
FIG. 2 is a greatly enlarged cross-sectional view of the sensing edge taken along line 2—2 of FIG. 1.

Referring now to FIG. 2, sensing edge 13 extends substantially along the lower or leading edge 15 of door 12. Sensing edge 13 and door 12 include securing means 16 for fixing sensing edge 13 to leading edge 15 of door 12. In the presently preferred embodiment, securing means are a pair of T-shaped members 16 which complement T-shaped slots in the lower surface of door 12. Of course, sensing edge 13 may be secured to door 12 in any other suitable manner, for instance, with a traditional dovetail slot configuration (not shown).

Sensing edge 13 is comprised of an outer casing or sheath 18 of elongate, generally constant cross-sectional outline configuration, extending closely along the underside or edge 15 of door 12. In the presently preferred embodiment, sheath 18 is generally of square cross section, but may be of any other suitable shape, such as circular or semi-circular (not shown).

Sheath 18 is advantageously fabricated of form-retaining, but flexible air impervious material, such as rubber, having a bottom wall 22 for engagement with the door threshold or ground (see FIG. 1). Sheath 18 further includes side walls 24 and 26 upstanding integrally from opposite side edges of bottom wall 22 and a top wall 28 extending between upper edges of side walls 24 and 26 in close facing or complementary relation with leading door edge 15. T-shaped members 16 are formed with sheath 18 along top wall 22 for releasably interconnecting engagement with leading edge 15, thereby facilitating quick and easy mounting or removal and replacement of sensing edge 13 with respect to door 12.

Figure 3:
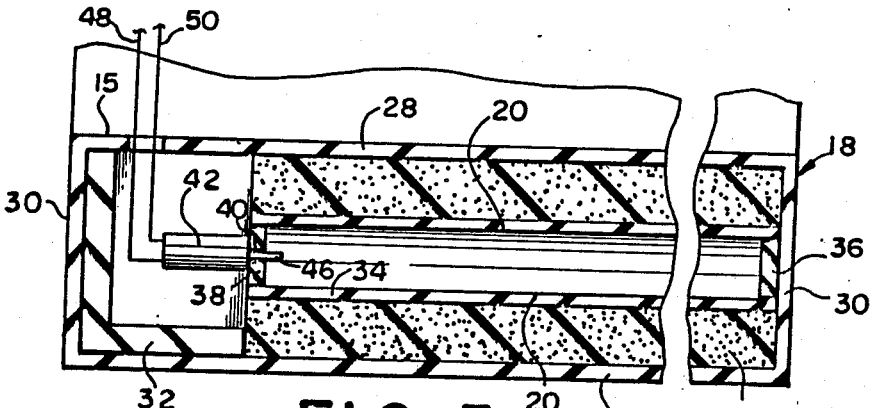
FIG. 3 is a cross-sectional view of the sensing edge taken along line 3—3 of FIG. 2.

Referring now to FIG. 3, end walls 30 close and seal sheath 18. Provided on a portion of the interior of sheath 18 at one end thereof is a relatively stiff or rigid incompressible transverse structure 32 extending completely across sheath 18, so as to effectively prevent or minimize compression and deformation of the sheath 18 at that location. In the presently preferred embodiment, transverse structure 32 is generally L-shaped in cross section and positioned at the left-hand end of sheath 18 (when viewing FIG. 3). The L-shaped transverse structure 32 is of a configuration which complements the internal cross-sectional configuration of sheath 18, and is fabricated of relatively stiff, incompressible material, such as firm rubber, metal or plastic. Transverse structure 32 may be of any other shape, such as C-shaped, as long as it effectively prevents compression and deformation of the surrounding portion of sheath 18. For instance, the transverse structure of the presently preferred embodiment may include bores or holes (not shown) to decrease shipping weight, without detracting from the requirement of a rigid structure.

Disposed generally centrally within sheath 18 is an elongate inner tubular member 34 fabricated of resiliently compressible air impervious material, such as rubber or closed cell foam. Tubular member 34 extends almost the complete length of sheath 18 and is longitudinally positioned and completely enclosed within sheath 18. In the presently preferred embodiment, tubular member 34 is generally of circular cross section (see FIG. 2), but may be of other cross-sectional shape such as square or oval (not shown). Tubular member 34 has first and second ends and extends longitudinally into abutting engagement with second or right-hand end wall 30 of sheath 18 (when viewing FIG. 3). Positioned within this second end of tubular member 34 is a plug 36 which is of a configuration conformable to the internal cross-section of tubular member 34 and sealingly positioned therein so as to prevent air from escaping between plug 36 and tubular member 34. In the presently preferred embodiment, plug 36 is sealed in position with epoxy, however, any suitable sealant (e.g., glue or cement) may alternatively be employed. Plug 36 may be constructed of any suitable rigid or stiff material. In the presently preferred embodiment, plug 36 is constructed of firm rubber, but may be constructed of plastic. If desired, tubular member 34 may be formed with the second or right-hand end permanently sealed (not shown).

The other or first end of the tubular member 34 preferably extends up to the transverse structure 32. Positioned within the other end (left-hand end when viewing FIG. 3) of tubular member 34 is a second plug 38 which is also of a configuration conformable to the internal cross-sectional configuration of tubular member 34, and fabricated of relatively stiff material, such as firm rubber or plastic. Plug 38 is sealingly secured within tubular member 34 as with plug member 36. Plug 38 further includes a generally centrally disposed bore 40 for receiving pressure sensing means 42 for sensing pressure change within tubular member 34.

Disposed in the area between sheath 18 and tubular member 34 is a resiliently compressible inner formation 44 which extends generally along the entire length of tubular member 34 (see FIG. 3). In the presently preferred embodiment, compressible formation 44 is preferably fabricated essentially of open cell foam and is substantially co-extensive with sheath 18, except for the space occupied by transverse structure 32. It is within the spirit and scope of the invention to construct compressible formation 44 of other materials, such as a closed cell foam. While on the other hand, it should be understood that formation 44 is not necessary for operation of the sensing edge 13 and, therefore, may not be included and the area between the inner tubular member 34 and the sheath 18 may be open. However, without formation 44, the sensitivity of edge 13 decreases.

Referring now to FIG. 3, protectively located between transverse structure 32 and the left-hand or other end of tubular member 34 is a pressure sensing means 42. Pressure sensing means 42 senses pressure change within the interior of tubular member 34. In the presently preferred embodiment, pressure sensing means 42 comprises a fluid pressure sensitive switch element, in which electrical contact is made or broken in response to pressure changes. The switch element is of a type well known in the art. Such pressure sensitive elements are manufactured by Micro Pneumatic Logic, Inc. of Fort Lauderdale, Fla. The pressure sensitive switch element is effectively protected from direct pressure and/or impact damage by embedding or otherwise enclosing the switch element within transverse structure 32. If desired, the switch element may also be encased with protective material, such as foam (not shown) which may be installed within the open area of the outer sheath 28 proximate the transverse structure 32. The switch element includes a pressure port or nipple 46 extending through plug bore 40 and communicating with the interior of tubular member 34. Thus, the switch element is in pneumatic communication from its mounting in the transverse structure 32 with the interior of tubular member 34. Pressure sensitive switch means 42 is provided with electrical conductors or leads 48 and 50 which extend outwardly in sealed relation from sheath 18 for connection with desired control circuitry (not shown) in a manner well known in the art.

In operation, the application of external pressure to sheath 18 caused by an obstruction to the closing of door 12 anywhere therealong (except at the location of transverse structure 32) is communicated by compressible formation 44 (or the air within the outer sheath if no compressible formation is employed) to tubular member 34, which is depressed an amount proportional to the magnitude of the external pressure. A slight depression in tubular member 34 increases the internal pressure therewithin and is sensed by the pressure sensing means 42 which actuates by making or breaking electrical contact in a manner well known in the art to effect a desired result, generally, the automatic opening of door 12 or automatically inhibiting door 12 from closing any further. Further, the sensing means 42 is protectively enclosed in transverse structure 32, which also serves upon normal ground engagement of door 12, to prevent the pressure within tubular member 34 from increasing and, thus, the actuation of the switch element. It is within the spirit and scope of the invention to incorporate a plurality of incompressible rigid transverse structures anywhere along sheath 18, for instance, adjacent plug 36.

The sensitivity of sensing edge 13 is adjustable. The switch element can be adjusted to actuate (make or break electrical contact) at any desired pressure change. In the presently preferred embodiment the switch element is set to a desired sensitivity before it is installed. In addition, by changing the material or size of the compressible inner formation 44 and/or tubular member 34 their density and thickness can be varied to adjust sensitivity prior to installation. In the presently preferred embodiment, the switch element is adjusted and the density and thickness of the elements 44 and 34 is selected such that sensing means 42 is actuated before the inner surfaces 20 of tubular member 34 contact each other. Therefore, sensing edge 13 actuates quickly in response to a slight depression in sheath 18 and is, therefore, highly sensitive to external pressure.

It is also within the spirit and scope of the invention to include a second pressure sensing means (not shown) as a redundant or back-up system. Furthermore, the two sensing means may operate in sequence with each other, as for controlling a plurality of separate functions, such as the stopping and reversing of door movement, or other desired functions.

From the foregoing description, it can be seen that the present invention comprises a sensing edge for a door to protect persons, equipment and the door from impact damage. The sensing edge of the present invention overcomes the problems of the prior art by providing a highly sensitive sensing edge with a pressure chamber within tubular member 34, which is less costly and easier to manufacture. It will be appreciated by those skilled in the art that changes could be made to the embodiment described above without departing from the broad inventive concepts thereof. It is understood, therefore, that this invention is not limited to the particular embodiment disclosed, but it is intended to cover all modifications which are within the scope and spirit of the invention as defined by the appended claims.

I claim:

1. A sensing edge for a door to protect persons, equipment and the door from impact damage, comprising:

an elongate outer sheath compressible upon application of external pressure and fabricated of flexible air impervious material for attachment to a door edge;

an elongate inner tubular member fabricated of resiliently compressible air impervious material longitudinally positioned and enclosed within said sheath, said inner tubular member having a first end and a second end, said second end being sealingly closed;

a substantially rigid, incompressible transverse structure positioned within a portion of the outer sheath and having a configuration which complements the interior cross section of said sheath to effectively prevent deformation of said sheath thereabout; and a pressure sensitive switch having a switch element protectively located within the portion of said sheath proximate to said transverse structure for sensing pressure change within said inner tubular member without subjecting the switch element to direct external pressure whereby upon application of external pressure to the sheath, anywhere therealong except at the portion encompassing said transverse structure, pressure within the tubular member is increased and thereby communicated to the pressure switch for actuation thereof.

2. The sensing edge as recited in claim 1 wherein an area is defined between said inner tubular member and said sheath and further including resiliently compressible foam configured to conformably occupy the area between said inner tubular member and said sheath.

3. The sensing edge as recited in claim 1 wherein said air impervious materials are rubber.

4. The sensing edge as recited in claim 1 wherein said transverse structure is positioned at said first end of said tubular member.

5. A sensing edge for a door to protect persons, equipment and the door from impact damage, comprising:

an elongate outer sheath compressible upon application of external pressure and fabricated of flexible air impervious material for attachment to a door edge;

an elongate inner tubular member fabricated of resiliently compressible air impervious material longitudinally positioned and enclosed within said sheath, said inner tubular member having a first end and a second end, said second end being sealingly closed;

a substantially rigid, incompressible transverse structure sealingly positioned within said tubular member and having a configuration which complements the interior cross section of said tubular member to effectively prevent deformation of said tubular member thereabout; and a pressure sensitive switch protectively located in and proximate to said transverse structure within said sheath for sensing pressure change within said inner tubular member without subjecting the switch element to direct external pressure whereby upon application of external pressure to the sheath, anywhere therealong except at the position of said transverse structure, pressure within the tubular member is increased and thereby communicated to the pressure switch for actuation thereof to effect a desired result.

6. The sensing edge as recited in claim 5 wherein an area is defined between said inner tubular member and said sheath and further including resiliently compressible foam configured to conformably occupy the area between said inner tubular member and said sheath.

7. The sensing edge as recited in claim 5 wherein said air impervious materials are rubber.

8. The sensing edge as recited in claim 5 wherein said transverse structure is positioned at said first end of said tubular member.

9. A sensing edge for a door to protect persons, equipment and the door from impact damage, comprising:

an elongate outer sheath compressible upon application of external pressure and fabricated of flexible air impervious material for attachment to a door edge;

a first, substantially rigid, incompressible transverse structure positioned at one end of said sheath and having a configuration which complements the interior cross section of said sheath to effectively prevent deformation of said sheath thereabout;

an elongate inner tubular member of resiliently compressible air impervious material longitudinally positioned and enclosed within said sheath, said inner tubular member having a first end and a second end, said first end being positioned proximate to said one end of said sheath, said second end being sealingly closed;

a second substantially rigid, incompressible transverse structure sealingly positioned at said first end of said tubular member and having a configuration which complements the interior cross section of said inner member to effectively prevent deformation of said inner member thereabout; and a pressure sensitive switch having a switch element protectively located in said first transverse structure within said sheath and between said first and second transverse structures for sensing pressure change within said inner tubular member without subjecting the switch element to direct external pressure whereby upon application of external pressure to the sheath, anywhere therealong except at the position of either transverse structure, pressure within the tubular member is increased and thereby communicated to the pressure switch for actuation thereof.

10. The sensing edge as recited in claim 9 wherein an area is defined between said inner tubular member and said sheath and further including resiliently compressible foam configured to conformably occupy the area between said inner tubular member and said sheath.

11. The sensing edge as recited in claim 9 wherein said air impervious materials are rubber.

12. The sensing edge as recited in claim 9 wherein said sheath includes a first wall and a second wall, said first wall being fixed to said door edge and further including a substantially rigid member located between said first and second transverse structures between said switch and said second wall to provide said switch element with further protection against direct external pressure.

* * * * *